US005085407A

United States Patent [19]

Lonon

[11] Patent Number: 5,085,407

[45] Date of Patent: Feb. 4, 1992

[54] MOTORIZED JACK

[76] Inventor: Edward M. Lonon, 155 Sanford St., East Orange, N.J. 07018

[21] Appl. No.: 499,219

[22] Filed: Mar. 19, 1990

Related U.S. Application Data

[63] Continuation-in-part of Ser. No. 437,644, Nov. 17, 1989, abandoned.

[51] Int. Cl.[5] ..... B66F 3/18

[52] U.S. Cl. ..... 254/103; 254/DIG. 2; 254/DIG. 1; 254/DIG. 3

[58] Field of Search ..... 254/DIG. 2, DIG. 3, 254/DIG. 1, 1, 103, 93 H, 122, 126

[56] References Cited

U.S. PATENT DOCUMENTS

| | | | |
|---|---|---|---|
| 3,392,959 | 7/1968 | Lewis | 254/103 |
| 3,881,692 | 5/1975 | Clarke | 254/DIG. 1 |
| 4,330,104 | 5/1982 | Klok | 254/DIG. 3 |
| 4,653,727 | 3/1987 | Chang et al. | 254/DIG. 2 |
| 4,872,230 | 10/1989 | Levine | 254/DIG. 2 |
| 4,919,392 | 4/1990 | Minuto | 254/DIG. 2 |
| 4,925,158 | 5/1990 | Yang | 254/1 |
| 4,943,034 | 7/1990 | Wagnon | 254/DIG. 2 |

*Primary Examiner*—Robert C. Watson

*Attorney, Agent, or Firm*—Mathews, Woodbridge & Collins

[57] ABSTRACT

A motorized jack assemblage for vehicles. This takes the form of a kit containing a motor and reduction gear linkage adapted to be energized from the cigarette lighter or other source of electrical power in the vehicle. The gear linkage is adapted to drive mechanical coupling means, which keys into and operates a lift jack, which in one case is part of the standard equipment for the vehicle, and in another case is a jack with a specialized base which is part of the kit.

13 Claims, 9 Drawing Sheets

MOTORIZED JACK

BACKGROUND OF THE INVENTION

This application is a continuation-in-part of my application Ser. No. 07/437,644 filed Nov. 17, 1989 now abandoned for Motorized Jack.

This relates in general to lifting devices for vehicles, and more specifically to a motorized jack assemblage for lifting automobiles, vans and trucks for tire changes and other repairs.

The conventional jack which is designed to be carried in the trunk of a car requires laborious manual operation to enable the vehicle to be raised or lowered to the desired height. Garages and other commercial vehicle repair and service stations are equipped with mechanized lifts which are raised or lowered by means of electrically controlled hydraulic or pneumatic systems. Until recently, no motorized jack has been available to a driver caught out on the road in a vehicle with a flat tire to change. An assemblage is now available on the market including a motorized jack which is adapted to be raised or lowered by power derived from the cigarette lighter on the dashboard or other portable auxilliary source.

The type of motorized jack presently available on the market has certain disadvantages, in that it is cumbersome to carry and to use, and is not readily disassembled to be carried or stored. Furthermore, it is not adapted for use with a standard jack of the type which is furnished by the manufacturer of certain types of vans.

Accordingly, it is the principal object of this invention to provide a kit for a motorized jack assemblage which is readily assembled and disassembled for storage and transport. A more particular objective of the invention is to provide means for collaborating with a type of jack which is conventionally furnished as standard equipment for certain types of vans, which when the jack is applied to the rear axle or bumper of a vehicle, may be operated electrically to enable the vehicle to be raised quickly and conventionally, with minimum effort on the part of the operator.

BRIEF DESCRIPTION OF THE INVENTION

These and other objects are realized in a kit in accordance with the present invention which can be readily assembled and disassembled for storage and transport; and moreover, certain embodiments are designed to collaborate with a standard-type jack or a jack furnished as stock equipment purchased with certain types of vans. The kit comprises a conventional low voltage, direct current electric motor which is constructed to be driven by power derived from a power outlet in the vehicle, such as a cigarette lighter, connected to the car battery or generator, or other portable electrical power source. The motor shaft and connected reduction gears are adapted to be connected to the jack through detachable mechanical coupling which is centered in driving relation on drive shaft which is extended laterally to key into a socket at the base of the conventional jack housing which is mounted on a supporting base. This slidebly engages a plate which also supports the motor and the reduction gears. Once the connection is made, the drive shaft functions to rotate the vertically-extended worm gear which raises and lowers the vertical lift shaft of the jack. In one embodiment, a jack fixed to a stable base is part of the kit. In another embodiment, the detachable mechanical coupling is constructed to key into and collaborate with a jack of the type furnished as standard equipment. In either case, the jack terminates at its upper end in a connected head having an insulating pad of rubber the like of which is shaped to engage the rear axle or bumper of the vehicle. The operation of the motor is controlled by a toggle switch which is interposed in the electric cable which connects the power source to the motor, which has three positions, left, right and central, corresponding to the jack movements positioned to raising, lowering and rest positions.

Ancillary features of the kit of the present invention are two small lamps mounted on the supporting base. One lamp in a rectangular housing, powered from the car battery, is hingedly connected to one edge of the supporting plate, next to the jack emplacment. This lamp is rotatable to an upward facing position to throw a light beam on the underside of the vehicle during the jacking operation. The other lamp, battery powered, is an elongated signal lamp, cylindrical in form, removably secured in a clamp along the opposite edge of the supporting plate. The signal lamp is adapted to be removed from its clamp to be used for signalling purposes during the jacking procedure.

In a modified form, the motorized jack assembly of the present invention may include a clutch mechanism which will provide for a gear shift to accommodate the lifting of heavier or lighter vehicles.

From a study of the attached drawings, and the detailed description hereinafter, it will be understood that the present invention provides in either of its embodiments a portable kit which can easily be carried with a jack in the trunk of a car, or van or other vehicle and is adapted to be positioned to raise the vehicle for changing a tire, or for other necessary repairs. It is contemplated that the motorized jack assembly of the present invention can also be used for other purposes, such as raising and maintaining the vehicle hood or trunk lid in raised position.

SHORT DESCRIPTION OF THE DRAWINGS

DETAILED DESCRIPTION OF THE INVENTION

Figure 1:
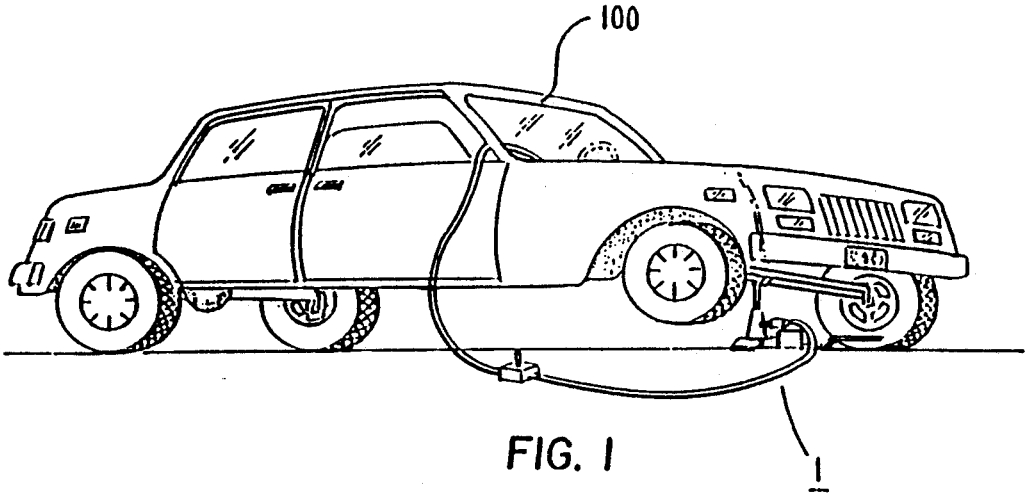
FIG. 1 shows the motorized jack assembly kit of the present invention including a jack fixed to a stabilized base for use on a conventional automobile.

Referring to the drawings, there is shown in FIG. 1 the motorized jack assembly kit 1 of the present invention as interposed under and in contacting relation with the front axle of a conventional automobile.

Figure 2:
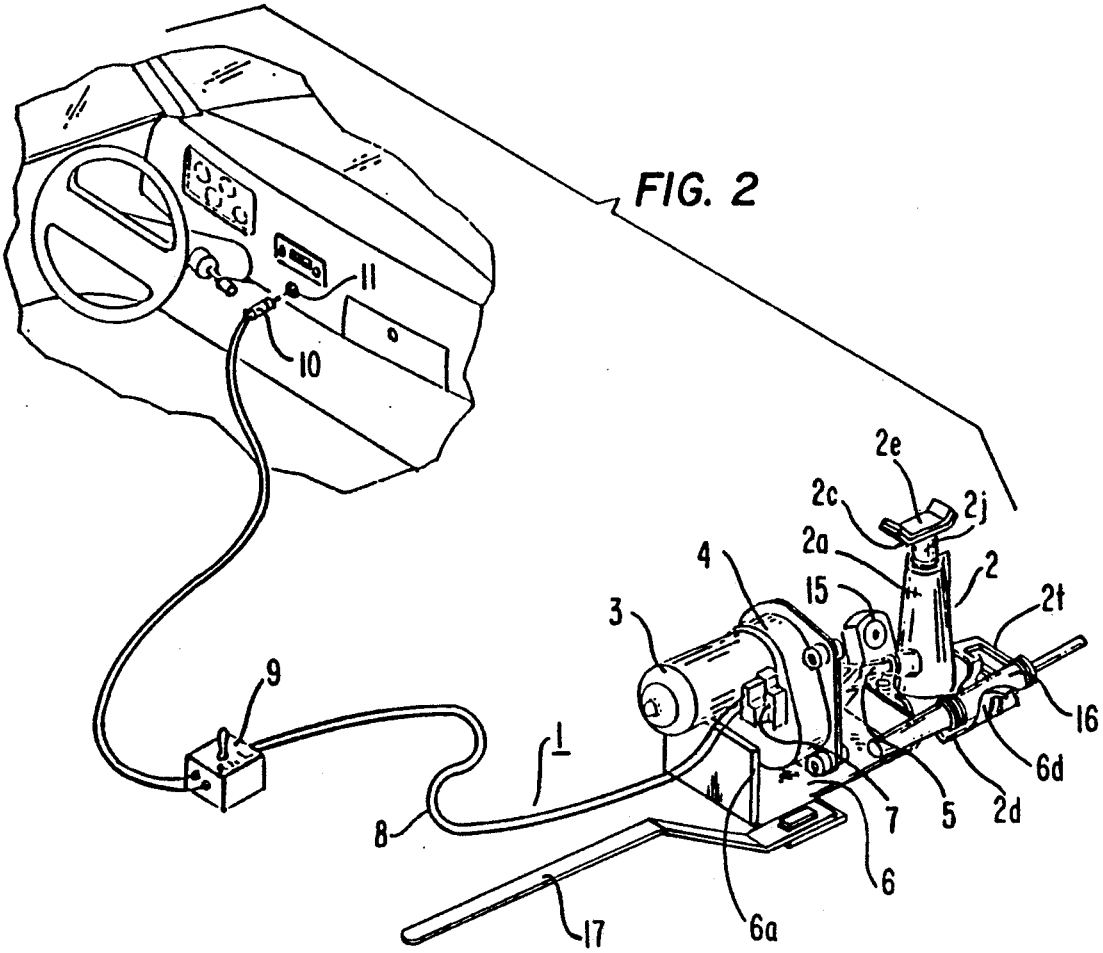
FIG. 2 is an overall showing of the motorized jack assembly kit of FIG. 1, having its connecting cables plugged into the cigarette lighter on the automobile dashboard, which is indicated in fragment.
Figure 3:
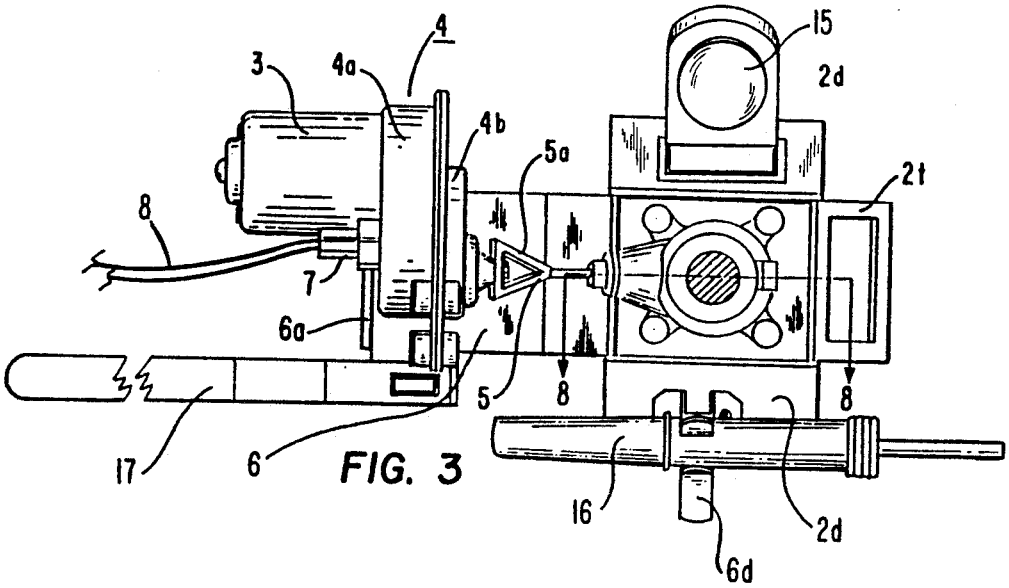
FIG. 3 is a top view of the components of the motorized jack assembly kit of FIGS. 1 and 2, assembled, with the mechanical coupling in place, and all of the elements in place on the supporting base, including the hinged lamp rotated to upward locking position.
Figure 4:
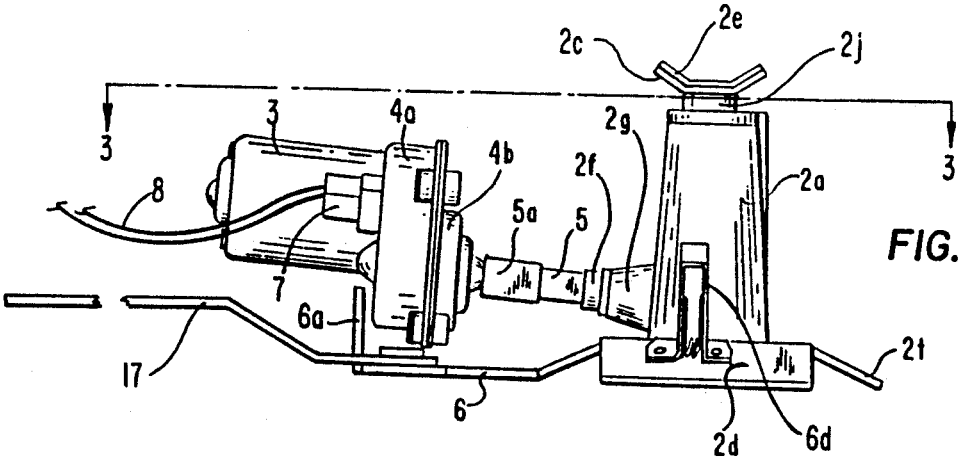
FIG. 4 is a side elevation view of one side of the jack assemblage of FIGS. 1 and 2, et seq. with the mechanical coupling to the drive shaft in place.
Figure 5:
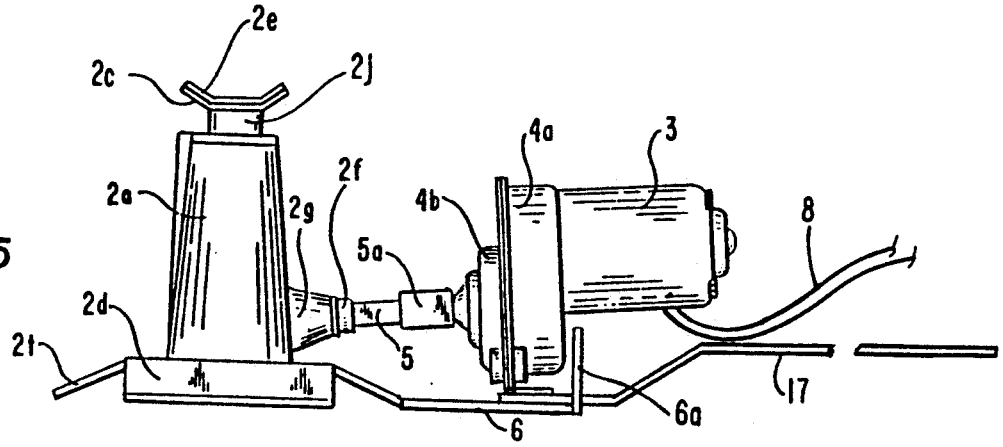
FIG. 5 is a side-elevational view from the other side of the motorized jack assembly of FIGS. 1 and 2 et seq. assembled in working position.
Figure 6:
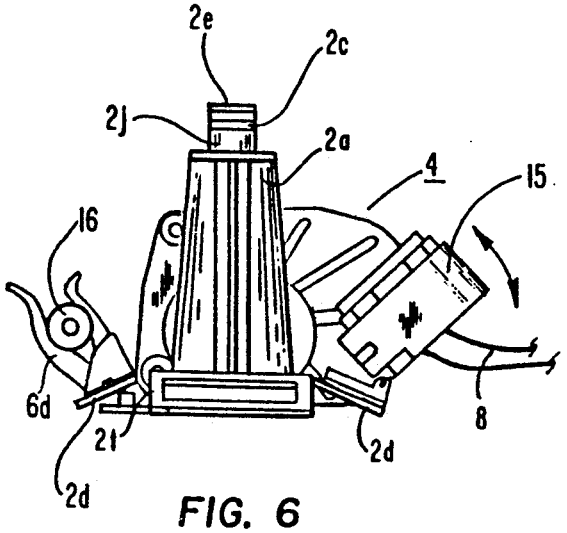
FIG. 6 is an end-elevational view from the outer end of the motorized jack of FIGS. 1 and 2 et seq., in place for operation.
Figure 7:
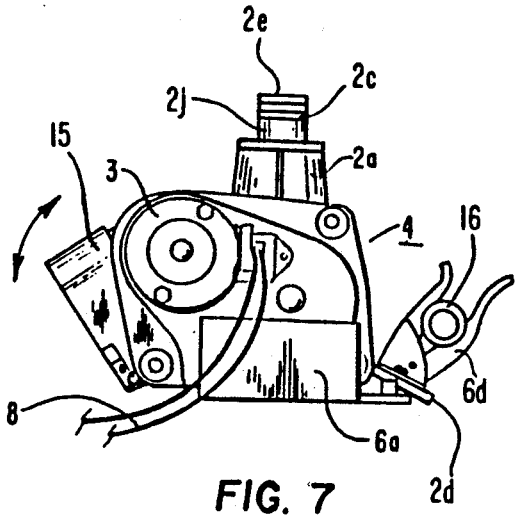
FIG. 7 is an end-elevational view of the inner end of the motorized jack assembly of FIGS. 1 and 2 et seq., connected to the energizing cable.

Referring to FIG. 2, the motorized jack assembly kit 1 collaborating with the jack 2, and comprising the isolated direct current motor 3, with the reduction gear linkage 4, mounted on the supporting plate 6, is connected by means of a two-way electrical cable 8 through the plug 10 to the cigarette lighter outlet 11 located on the automobile dashboard. The latter outlet 11 supplies 12 volts direct current to the circuit of motor 3 under control of a conventional three-way toggle switch 9, which has an "off" or neutral position, and right and left positions, respectively, providing positive or negative current flow.

The other end of the cable 8 is plugged into the circuit of the isolated direct current motor 3 through the two-way inlet receptacle 7.

A motor 3, suitable for the purposes of the present invention, may be, for example, an isolated direct current motor, such as used with the wiper and linkage assembly of the windshield wiper, (with the blade assembly removed), as used on the U.S. and Canadian models of the Dodge Omni, and, which motor is designated Part No. 5211024, with date code 0378 imprinted thereon in red ink. A typical wiper motor 3, and reduction gear assemblage 4, of a type suitable for the purposes of the present invention, is shown and described on pages 149, 150 and 151 of the Chilton Book Company "Repair & Tune Up Guide", Omni Horizon Rampage, 1978–86, published by the Chilton Book Company of Radnor, Pa., © Copyright 1987, Library of Congress Catalogue Card No. 85-47985.

The motor 3, in the present example, is 15 inches in axial length, about 4½ inches in overall width, and weighs about 12 pounds.

The conventional reduction gear linkage 4, which is mechanically coupled to the shaft of the motor 3, is mounted in a housing contiguous to motor 3. The gear linkage 4 is designed in the present illustrative embodiment to provide a fixed gear reduction ratio to the rotating shaft 4*a*. It is contemplated that in a modified embodiment, clutching means may be provided to enable the use of several different gear ratios to make the motorized jack assemblage 1 adaptable for raising and lowering bodies of different weights.

FIG. 2 shows the motor reduction gear linkage and motorized jack components of FIG. 1 as viewed in perspective. FIGS. 3, 4, 5, 6 and 7 show the combination from the top, left side, right side, inner and outer ends, respectively.

The rotating shaft 4*c* which is driven to move rotatably about its axis by the motorized reduction gear linkage 4*a*–4*b* housed in continguous relation to motor 3 extends out laterally from the center of the outer face of the housing. The shaft 4*c* terminates in a projecting nub which is acommodated in a slot 5*c* of the mechanical coupling means 5. (See FIG. 9). The mechanical coupling means 5 has a head portion 5*a* which in the present embodiment has a frustotriangular head, which is welded or otherwise secured in axial relation to the rotating shaft 4*c* of reduction gear linkage 4 which is mated to slot 5*c*.

Figure 8:
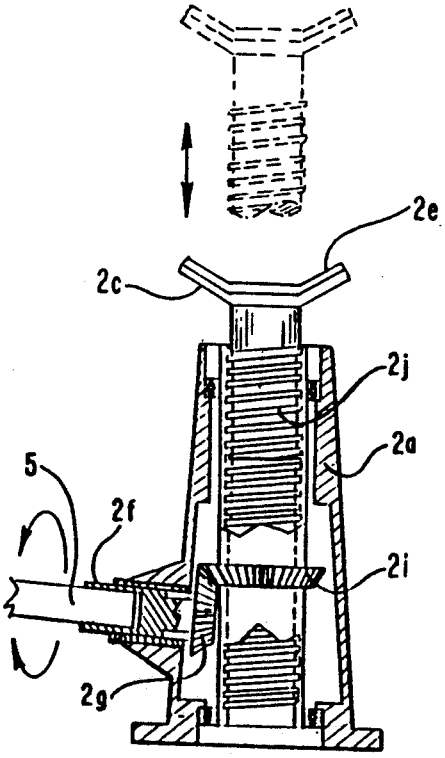
FIG. 8 is a side elevational view, partly in section, of the jack and mechanical coupling to the motor and gear linkage for the assemblage of FIGS. 1 and 2 et. seq.

Referring to FIG. 8 in the embodiment under description, the jack 2 takes the form of a conventional mechanical jack, having a hollow, substantially cylindrical or slightly frusto-conical housing 2*a* having an outer diameter of, say, 3 inches at the base, a height of, say, 6 inches, and a slightly smaller outer diameter at the top. The inner diameter of housing 2*a* in the present embodiment is, say, 2 inches wide. The lift shaft 2*j* is a solid metal rod, say, 21 inches long and 1¾ inches in overall diameter. The lower end of the lift shaft 2*j*, which is interposed in axial relation into the hollow interior 2*h* of the cylindrical housing 2*a*, is screw-threaded from the bottom to a height of say, a foot, with threads 2*k*. Teeth are mounted on the inner surface 2*h* of the cylindrical housing 2*a* and designed to engage threads moving the shaft 2*j* up and/or down, depending on which way the shaft is rotated by rotation of the conventional bevel gears 2*g*, 2*i*. The smooth portion of lift shaft 2*j* extends up vertically say, 3½ inches above the screw-threaded portion, and terminates in a saddle-shaped metal seat 2*c*, comprising a metal piece about ¼ inch thick, about 2¾ inches long and 2½ inches wide, the longer side having a slight concavity on its upper surface to accommodate the curvature of an axle it is constructed to.

Bonded to the top surface of the metal seat 2*c* is an insulating rubber covering 2*e*, say 1 inch thick, which is coextensive with the seat 2*c*, and which is constructed to engage the axle of the vehicle 100, when the jack assembly is in use.

The jack 2 is designed in the application under description to be raised to a height of say, 9 inches. It will be understood, however, that the jack can be of a different form than that shown in the illustrative example and can be designed to be raised to any desired height.

Figure 9:
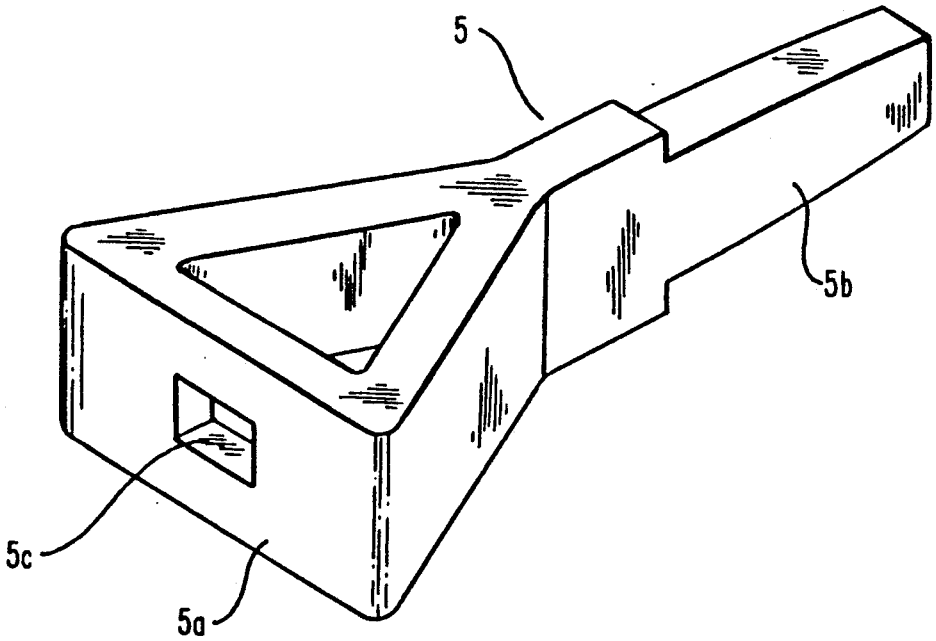
FIG. 9 is a perspective showing of the mechanical coupling key of the assemblage of FIGS. 1 and 2, et seq. which functions to couple the drive shaft to the raising and lowering mechanism of the jack.

Referring to FIG. 9, the projecting end 5*b* of mechanical coupler 5 is secured in the socket sleeve 2*q* of jack 2, which houses the shaft 2*j* disposed for rotation in the sleeve 2*d*. Shaft 2*d* rotates in sleeve 2*q* to rotate the bevel gear 2*g* which mates with gear 2*i* in the body of the jack 2. The latter gear 2*i* rotates in a horizontal plane and serves to rotate shaft 2*j*, the lower end of which is screw threaded, and engages and moves up or down on the screw threads in a conventional manner causing the screw-threaded shaft 2*j* to be raised or lowered to a maximum height of, say, about 15 inches above its rest position, or to be lowered from its maximum height to the rest position, depending on the position of toggle switch 9, which is turned to right, left or neutral position to control whether motor 3 rotates clockwise or counterclockwise or is at rest.

In the presently described embodiment, a supporting steel platform 6, say about 7½ inches wide, 3/16 inch thick, and 22½ inches long, is provided for mounting the elements of the kit.

Welded or otherwise fastened along the left-hand edge of the supporting platform 6 is a rectangular vertical flange 6*a*, which is 6 inches long and 2¼ inches high, and 3/16 inch thick, extending from the rear edge of plate 6 to within 1½ inches of the opposite parallel edge. This serves to support the motor 3 and gear linkage 4 in their respective housings. The outer end of the cylindrical motor housing 3 is constructed to rest tangentially on the upper edge of the flange 6*a*; and the inner end is secured to the housing of gear linkage 4, which terminates in the flat metal plate 4*a*. The latter is supported to the supporting plate 6, and is secured to a second flat plate 4*d* by bolts 13*a*, 13*b*, whereby the motor 3 and gear linkage 4 in their housings are secured firmly in place on the supporting plate 6. Thus, the projecting rotating member 5*b* of the mechanical coupling means 5 (FIG. 9), is directed inward along a plane parallel to the surface of supporting plate 6. The projecting member 4*c* mates with the slot 5*c* in the mechanical coupling means 5 shown in FIG. 9.

The mechanical coupling member 5, which is a salient feature of the present invention, is formed from a steel slug of rectangular section, say, ½ inch wide, and 3/16 inch thick.

The "head" portion 5*a* forms, in a horizontal plane, a hollow substantially equilateral triangle, centered in the base of which is the slot 5*c* for connection with the projection 4*c* of the gear linkage 4. Formed integrally with the apex of the triangular head 5*a*, is the projecting shaft 5*b* having a rectangular section which extends 2 inches in an axial direction, is, say, 3/16 inch thick in a horizontal plane. This is shaped to key into and mate with the rectangular slot 2*d*, in the projecting sleeve 2*q* at the base of jack 2, to implement the raising and lowering of the jack 2 as previously described.

The base 2*p* of housing 2*a* of the jack 2 is welded, bolted or otherwise fixed in centered relation to the upper surface of the supporting plate 6 adjacent the end 2*f* of supporting plate 6 opposite to the end on which flange 6*a* supports the housing of the motor 3.

The jack 2 is positioned on the supporting plate 6 to receive the projecting key 5*b* inserted into the slot 2*d* in projecting sleeve 2*q* to provide an operative coupling between the motor 3 and gear-linkage 4 and the rotating shaft 4*c*, which is readily detachable for storage when the jack operation is completed.

As added features, the lights 15 and 16 are provided with the kit of the present invention.

Platforms 15*a*, and 16*a*, which may, for example, be steel plates 4 inches long, 1½ inches wide, and 3/16 inch thick, take the form of a pair of steel flanges about 3/16 inch thick, ½ inch high, and ½ inch across the top, which are disposed on opposite sides adjacent the base 2*p* of the jack 2.

The plate 15*a* supports an electric lamp 15, in a conventional housing, the lamp 15 being empowered through the electrical cable 8*c* from the car battery or other source used to drive the motor 3. The lamp 15 and its reflector are designed, when in storage position on plate 15*a*, to direct a beam inward parallel to the surface of plate 6. The other edge of the plate 15*a* is hinged by conventional hinging means applied to the outer edge of the upper surface of supporting plate 6, so that when the motorized jack assembly of the present invention is in use, the housing of lamp 15 can be tipped backwards, so as to direct the beam at any desired angle to the underside of the vehicle.

Attached to the upper surface of 16*a* are a pair of conventional resilient clamps 16*d* which function as a storage position for a battery lighter signal lamp 16, in a conventional cylindrical housing 16*a*, and having a handle 16*b*. The lamp is available to be used separately from the jack assembly as a distress or warning signal placed on or near the vehicle being worked on, or for whatever other purpose the user wishes.

The entire assemblage, as described herein, weights less than 20 pounds; and when the plug 10 is unplugged from the outlet 11, the entire assemblage can be readily stored in the trunk of a conventional automobile. To make the combination more portable, it is contemplated that a rigid handle 17 may be added to the supporting platform 6 at the end adjacent to the motor 3. One end of the handle 17 has a slot 17*a* which fits over a boss 6*x* on one corner of the supporting platform 6 to hold the handle in place, for convenience in positioning the jack assembly underneath the car being worked on.

Figure 10:
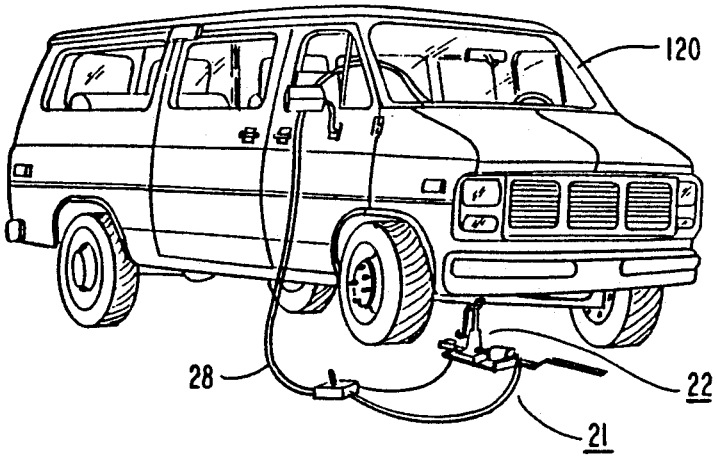
FIG. 10 shows a van being serviced by another embodiment of the kit of the present invention which collaborates with the jack furnished as standard equipment to the vehicle.

FIGS. 10 et seq. show a modification of the kit shown in FIGS. 1–9, the modification of FIG. 10 being adapted primarily for use with vans, such as the U.S. and Canadian models of the Dodge Omni, for which jacks are supplied as standard equipment. The kit to be used with FIGS. 10 et seq. is made to be disassembled and, if necessary, stored separately from the jack.

Although an embodiment of the mortorized jack assembly kit 1 of the present invention has been described in detail for purposes of illustration, it will be understood that the invention is not limited to the specific form shown, and can be used with other types of vehicles than those shown, such as vans and trucks. The invention is to be construed as limited only by the scope of the appended claims, hereinafter.

Referring to FIG. 10, the motorized jack assembly kit collaborates with the standard van jack 22, and as in the model previously described, comprises the direct current motor 23, with the reduction gear linkage 24, mounted on the supporting plate 26. This assemblage is connected by means of a two-way electrical cable 28 through the plug 30 to the cigarette lighter outlet 31 located on the automobile dashboard. The latter outlet 31 supplies 12 volts direct current to the circuit of motor 23 under control of a conventional three-way toggle switch 29, which has an "off" or neutral position, and right and left positions, respectively, providing positive or negative current flow.

The other end of the cable 28 is plugged into the circuit of the isolated direct current motor 23 through the two-way inlet receptacle 27.

For convenience of description, 20 has been added to the designating numbers of like units described with reference to the kit of FIGS. 1–9, and may be assumed to be the same as previously described, unless otherwise stated.

The motor 23, suitable for the purposes of the present embodiment, may be assumbed to be substantially similar to motor 3, previously described.

A typical wiper motor 33, and reduction gear assemblage 24, suitable for the purposes of the present invention, are similar to the corresponding types previously described with reference to FIGS. 1 et seq.

As in the previously described embodiment, the conventional reduction gear linkage 24, which is mechanically coupled to the shaft of the motor 23, is mounted in a housing contiguous to motor 23. The gear linkage 24 is designed in the present illustrative embodiment to provide a fixed gear reduction ratio of to the rotating shaft 24*c*. It is contemplated that in a modified embodiment, clutching means may be provided to enable the use of several different gear ratios to make the motorized jack assemblage 21 adaptable for raising and lowering bodies of different weights.

Figure 11:
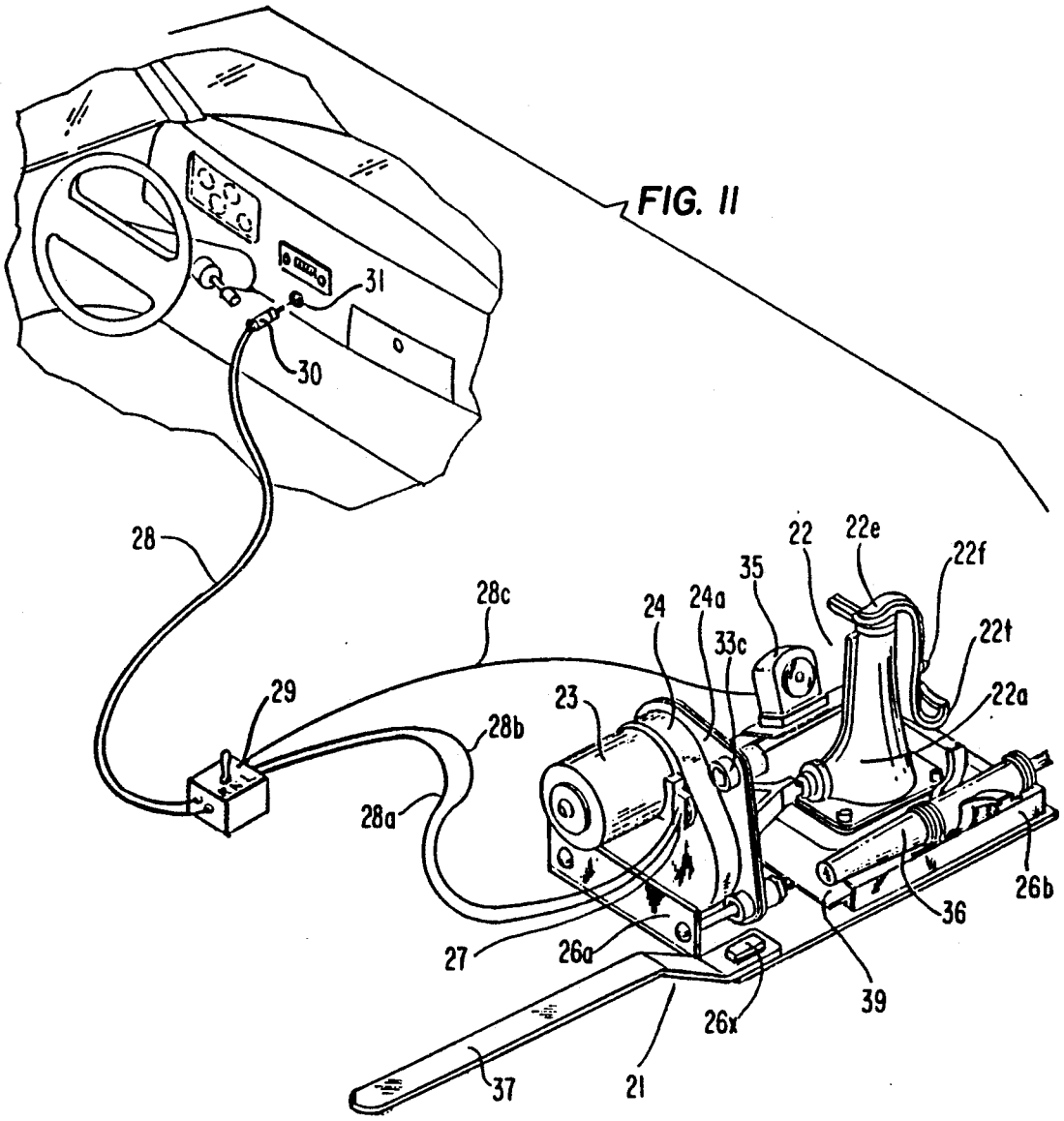
FIG. 11 is an overall showing of the motorized jack assembly kit of FIG. 10, using the standard van jack, having the connecting cables plugged into the cigarette lighter on the automobile dashboard which is indicated in fragment.
Figure 12:
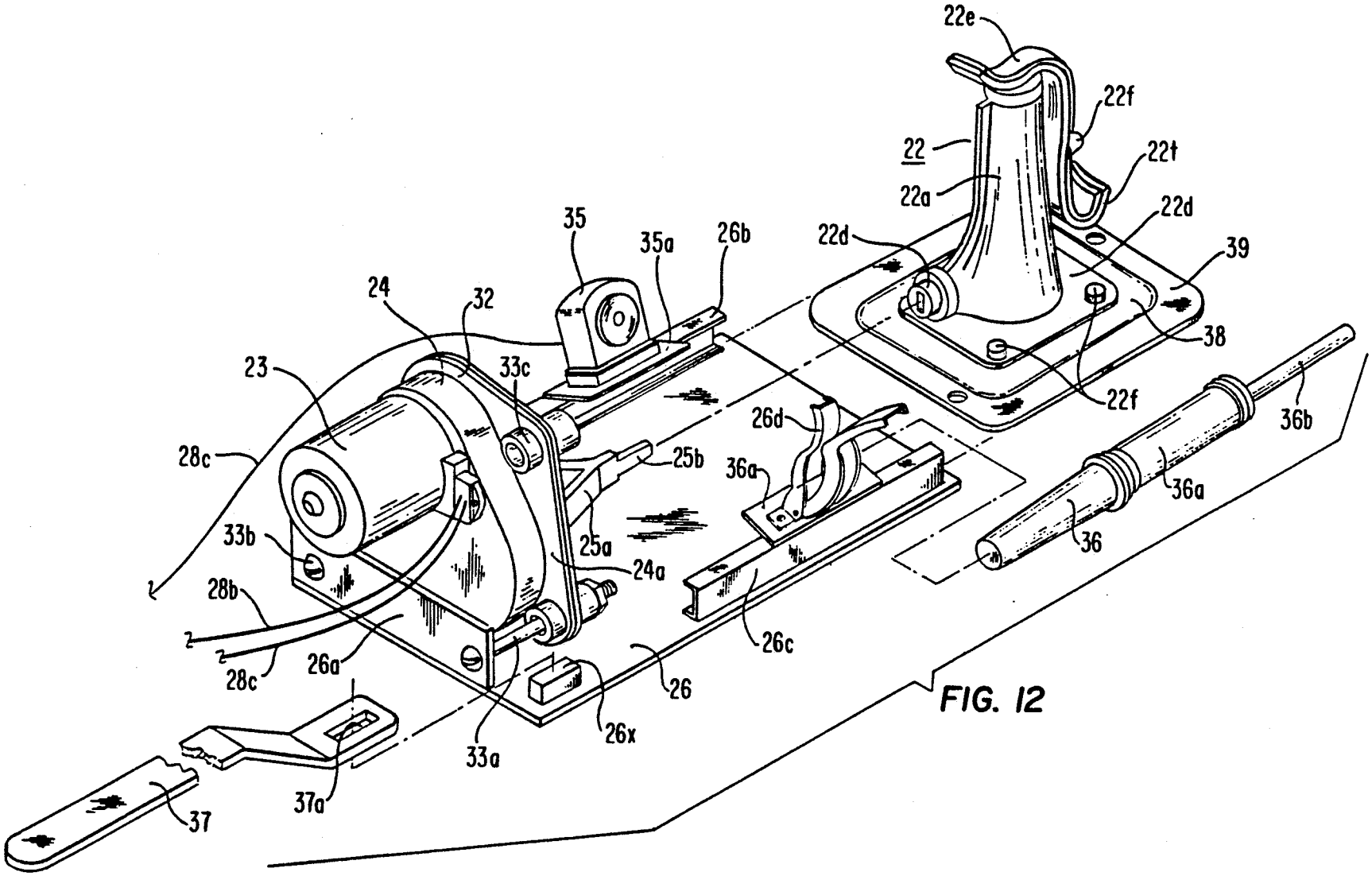
FIG. 12 is a perspective view of the components of the motorized jack assembly kit of FIG. 11, in the process of being assembled.
Figure 13:
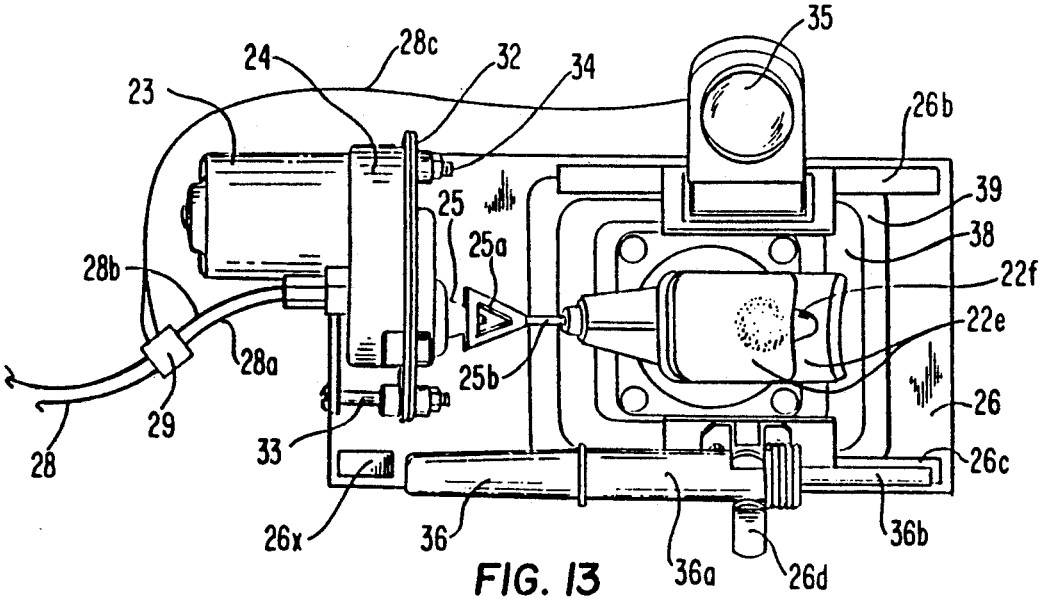
FIG. 13 is a top view of the motorized jack assembly kit of FIGS. 11 and 12 with all of the elements in place on a supporting plate.
Figure 14:
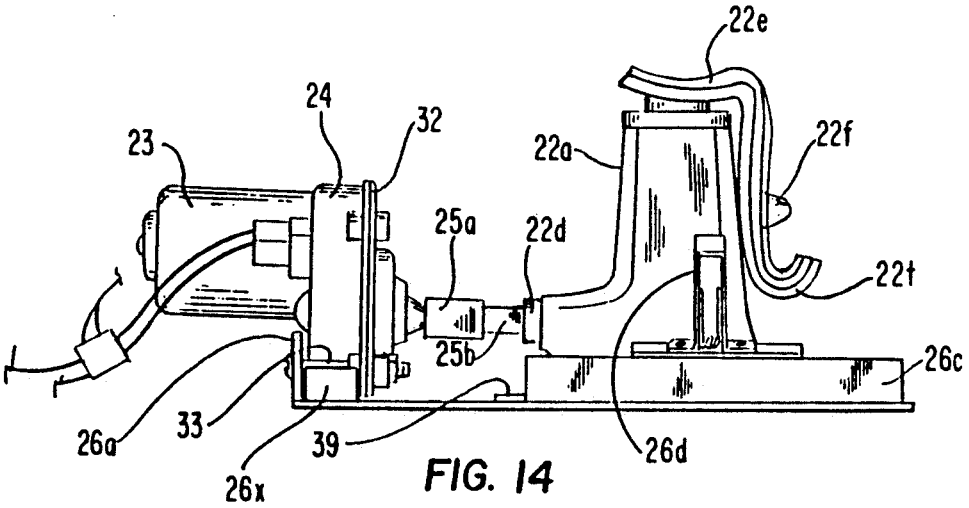
FIG. 14 is a side elevational view from one side of the motorized jack assembly kit of FIGS. 11 and 12 in working position.
Figure 15:
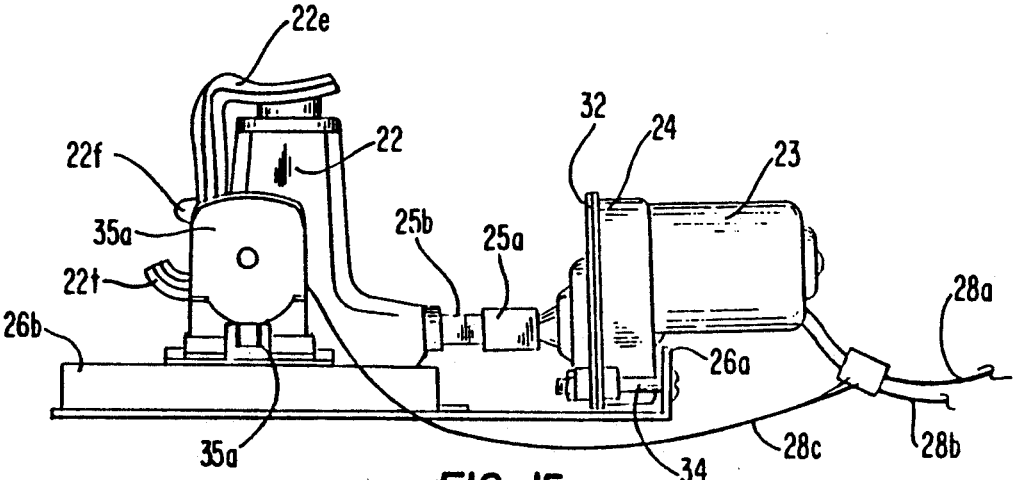
FIG. 15 is a side elevational view of the other side of the motorized jack assembly of FIGS. 11 and 12 et seq. in working position.
Figure 16:
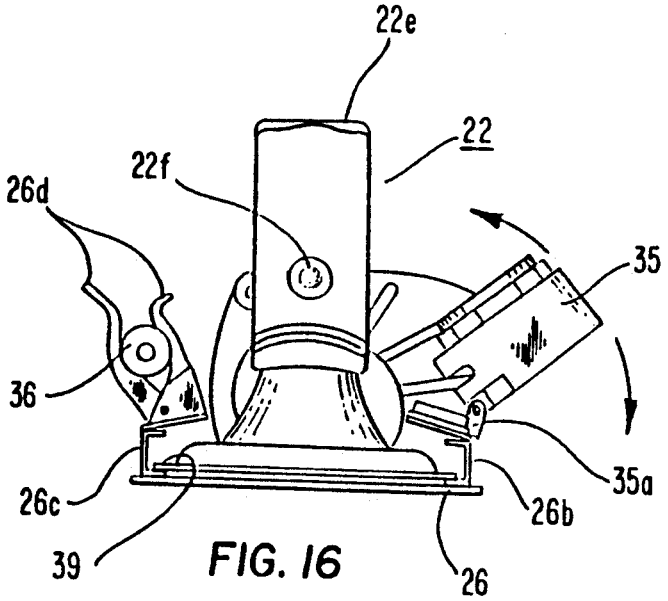
FIG. 16 is an end elevational view from the outer end of the motorized jack assembly of FIGS. 11 and 12 et seq. in place for operation.
Figure 17:
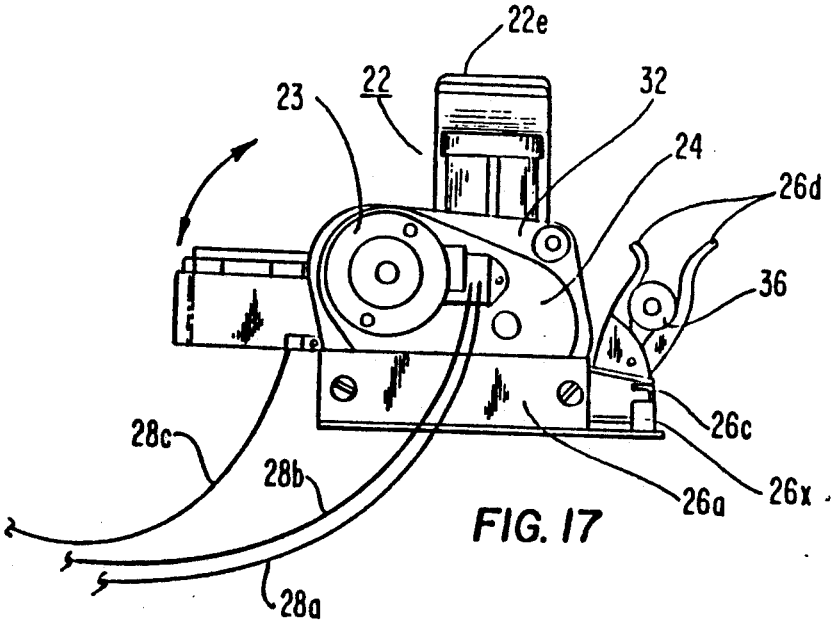
FIG. 17 is an end elevational view of the inner end of the motorized jack assembly of FIGS. 11 and 12 et seq. connected to the emerging cable.

FIG. 11 shows the motor reduction gear linkage and motorized jack components assembled, as viewed in perspective. FIG. 12 shows the standard van jack 22 in the process of being slipped into place on the supporting plate 26. FIGS. 13, 14, 15, 16 and 17 show the combination in operating position from the top, left side, right side, inner and outer ends, respectively.

The rotating shaft 24*c* which is driven to move rotatably about its axis by the motorized reduction gear linkage 24 housed in continguous relation to motor 23 extends out laterally from the center of the outer face of the housing. The shaft 24*c* terminates in a projecting nub which is acommodated in a slot of the mechanical coupling means 25, which is similar to that source in FIG. 9 with reference to the description of the previous embodiment. The mechanical coupling means 25 has a head portion 25*a* which in the present embodiment has a frusto-triangular head, which may be welded or otherwise secured in axial relation to the rotating shaft 24*c* of reduction gear linkage 24 which is mated to slot 25*c*.

Figure 18:
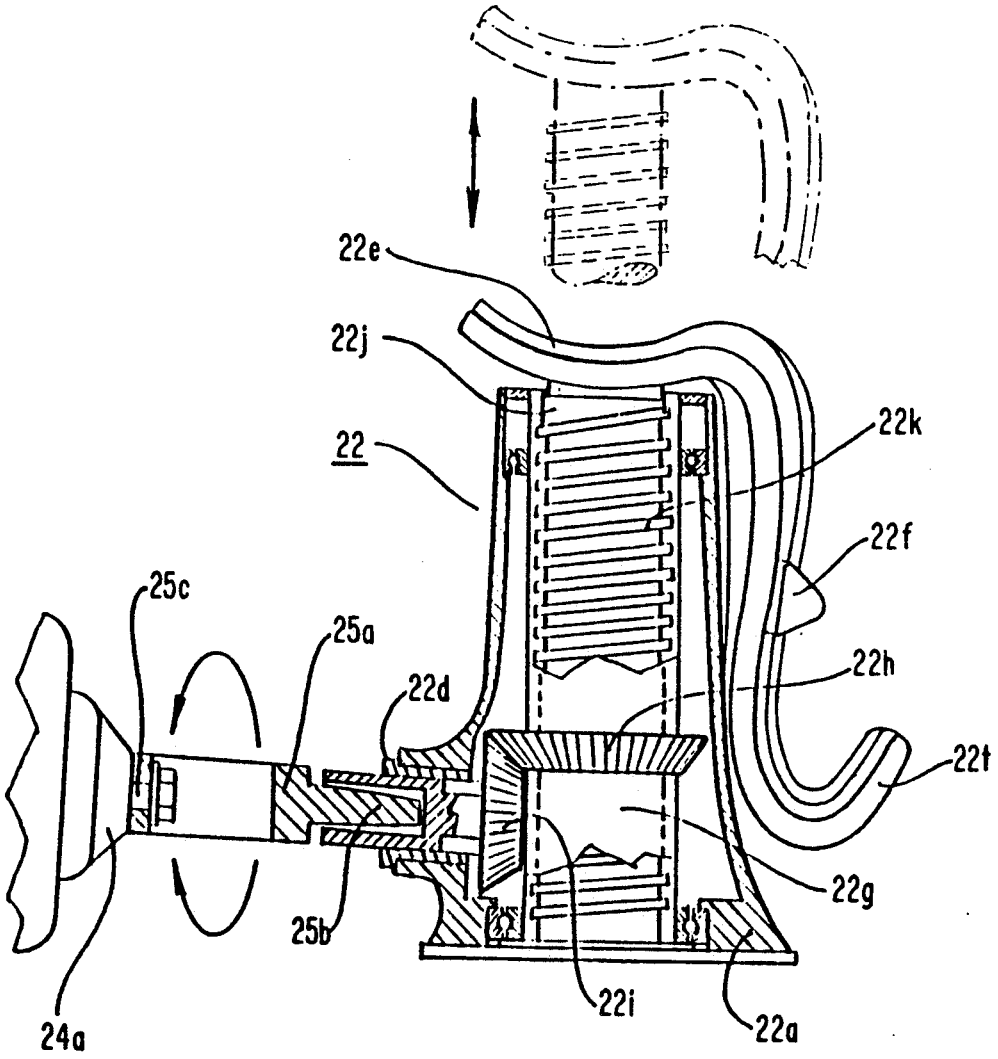
FIG. 18 is a sectional showing of a jack especially adapted for use with either the axle or the bumper of a standard van in collaboration with the kit of the present invention, having an insulating covering.

Referring to FIG. 18 in the embodiment under description, the jack 22 takes the form of a conventional mechanical jack, of a type which is standard equipment for many vehicles, having a hollow, substantially cylindrical or slightly frusto-conical form 22*a* having a base 22*p* with an outer diameter of, say, 3 inches at the base, a height of, say, 6 inches, and a slightly smaller outer diameter at the top. The inner diameter of base 22*p* in the present embodiment is, say, 2 inches wide. The lift shaft 22*j* is a solid metal rod, say, 21 inches long and 1¾ inches inoverall diameter. The lower end of the lift shaft 22*j*, which is interposed in axial relation into the hollow interior 22*n* of the base 22*a*, is screw-threaded from the bottom to a height of say, a foot, with threads 22*j*. Teeth are mounted on the inner surface of the hollow base 22*h* and designed to engage the threads 22*k*, moving the shaft 22*j* up and/or down, depending on which way the shaft is rotated by rotation of the conventional bevel gears 22*g*, 22*i*. The smooth portion of lift shaft 22*j* extends up vertically say, 3½ inches above the screw-threaded portion, and terminates in a saddle-shaped metal seat 22*e*, comprising a metal piece about ¼ inch thick, about 2¾ inches long and 2½ inches wide, the longer side having a slight concavity on its upper surface to accommodate the curvature of an axle it might engage.

Integral with metal seat 22*e*, and depending from one edge of the longer side is an attachment 22*f* which extends down vertically about 5½ inches and terminates in downardly and upwardly curved hooks which are adapted to engage the automobile bumper, if it is desired to use the jack 22 as a bumper lift.

The jack 22 is designed in the application under description to be raised to a height of say, 9 inches. It will be understood, however, that the jack can be of a different form than that shown in the illustrative example and can be designed to be raised to any desired height.

As in the previously described embodiment, the projecting end 25*b* of mechanical coupler 25 is secured in the socket end of jack 22, which houses the shaft 22*j* disposed for rotation in the sleeve 22*g*, which rotates in a vertical plane to rotate the bevel gear 22*g* in the body of the jack 22. The latter gear 22*g* engages the bevel gear 22*i* which rotates in a a horizontal plane in the body of the jack 22, which serves to rotate shaft 22*j*, the lower end of which is screw threaded, and engages and moves up or down on the screw threads 22*k* in a conventional manner causing the same to be raised or lowered to a maximum height of, say, about 15 inches above its rest position, or to be lowered from its maximum height to the rest position, depending on the position of toggle switch 29, which is turned to right, left or neutral position to control whether motor 23 rotates clockwise or counter-clockwise or is at rest.

In the presently described embodiment, the base 22*p* of the jack 22 is welded or otherwise secured as by screws 22*r* to a metal supporting platform 38, say, 6 inches long and 5 inches wide, which in turn, bolted or otherwise secured to a rectangular supporting plate 39 which is 6½ inches wide and 8½ inches long.

A separate supporting steel platform 26, say 14 inches long, 7½ inches wide, and 3/16 inch thick is provided as a separate element of the kit of the present invention.

Welded or otherwise fastened along the left-hand edge of a supporting platform 26 is a rectangular vertical flange 26*a*, which is 6 inches long and 2¼ inches high, and 3/16 inch thick, extending from the rear edge of plate 26 to within 1½ inches of the opposite parallel edge. This serves to support the motor 23 and gear linkage 24 in their respective housings. The outer end of the cylindrical motor housing 23 rests tangentially on the upper edge of the flange 26*a*, the inner end being secured to the housing of gear linkage 24, terminating in the flat metal plate 4*a*, normal to the shaft of motor 23, which plate is bolted, or otherwise secured to a second flat plate 32. The bolt 33*a* and a matching bolt 33*b* on the opposite side, extend from the outer surface of the flange 26*a* through the plates 24*a* and 12, and which, together with an additional bolt 33*c* near the upper edge of the plate, secure the motor 33 and gear linkage 24 in their housings firmly in place on the supporting plate 26 so that the projecting rotating member 25*b* is directed inward along a plane parallel to the surface of supporting plate 26. Thus, the projecting member 24*a* mates with the slot 25*c* in the mechanical coupling means 25 shown in FIG. 4.

The latter, which is a salient feature of the present invention, is formed from a steel slug of rectangular section, and is of the same general form and shape as mechanical coupling means 5 described in detail with reference to FIG. 9.

As in the previously described embodiment, this is shaped to key into and mate with the rectangular slot 22*d* at the projection 22*q* base of jack 22, to implement the raising and lowering of the jack 22 as previously described.

A pair of lateral U-shaped flanges 26*b* and 26*c* are bolted or otherwise secured to the opposite edges of the supporting plate 26, respectively extending, say 4 inches along its opposite edges, and terminating near the outer end of the plate. The U-shaped flanges 24*b* and 24*c* are formed of steel plate, say 3/16 inch thick, and are ½ inch high, and ½ inch across the top. They form internally-directed tracks along the opposite edges of supporting plate 26 which accommodates the base plate 39 of the jack 22 in slideable relation. The jack 22 can be moved slideably into position on supporting plate 26, and the projecting key 25*b* inserted into the slot 22*d* at the base of jack 22 to provide an operative coupling between the motor 23 and gear-linkage 24 and the rotating shaft 24*c*, which is readily detachable for storage when the jack operation is completed.

As added features, the lights 35 and 36 are provided with the kit of the present embodiment, and are structured and function in a manner to the previously described lamps 15 and 16.

The entire assemblage, as described herein, is light in weight; and when the plug 10 is unplugged from the outlet 11, the entire assemblage can be readily stored in the trunk of a conventional automobile. To make the combination more portable, it is contemplated that a rigid handle 37 may be added to the supporting platform 26 at the end adjacent to the motor 23. One end of the handle 37 has a slot 37*a* which fits over a boss 26*x* on one corner of the supporting platform 26 to hold the handle in place, for convenience in positioning the jack assembly underneath the car being worked on, as previously described.

Although the embodiments of the mortorized jack assembly kit 1 and 20 of the present invention have been described in detail for purposes of illustration, it will be understood that the invention is not limited to the specific forms shown, and can be used with other types of vehicles than those shown. The invention is to be construed as limited only by the scope of the appended claims.

What is claimed is:

1. A motorized jack assemblage comprising a kit adapted to collaborate with a jack having gearing means for raising or lowering a vehicle, said jack having a hollow cylindrical housing mounted on a supporting base, and a load supporting shaft coaxially mounted in said housing and comprising means for raising and lowering said load supporting shaft in vertical relation to said housing; which kit comprises in combination:

a supporting plate;

a direct current motor;

a cable comprising terminal means constructed to connect said motor in energy transfer relation to a source of power available in said vehicle;

reduction gear linkage connected in driven relation to said motor;

a drive shaft connected to be driven in rotation by said reduction gear linkage;

mechanical coupling means connected to be detachably coupled in mating relation between said drive shaft and said jack whereby connection of said coupling through a socket in the base of said jack is constructed to actuate the gearing means in said jack to cause the load supporting shaft of said jack to be raised or lowered in said cylindrical housing in response to the direction of rotation of said shaft; and electrical switching means connected to said cable having positive, negative and neutral current flow positions when said cable is connected to a source of power, for controlling the operation of said motor in driving relation to said reduction gear linkage and said drive shaft to raise or lower or stop the motion of said load supporting shaft in said jack housing in accordance with the position of said switch.

2. A kit in accordance with claim 1 comprising a supporting plate, means for removably securing said motor and said reduction gear linkage to said supporting plate.

3. A kit in accordance with claim 2 wherein said supporting plate comprises means for securely accommodating the supporting base of said jack in secured detachable relation on said supporting plate.

4. A motorized jack assemblage comprising a kit adapted to collaborate with a jack having gearing means for raising or lowering a vehicle, said jack having a hollow cylindrical housing mounted on a supporting base, and a load supporting shaft coaxially mounted in said housing and comprising means for raising and lowering said load supporting shaft in vertical relation to said housing; which kit comprises in combination:

a supporting plate;

a direct current motor;

a cable comprising terminal means constructed to connect said motor in energy transfer relation to a source of power available in said vehicle;

reduction gear linkage connected in driven relation to said motor;

a drive shaft connected to be driven in rotation by said reduction gear linkage;

mechanical coupling means connected to be detachably coupled in mating relation between said drive shaft and said jack whereby connection of said coupling through a socket in the base of said jack is constructed to actuate the gearing means in said jack to cause the load supporting shaft of said jack to be raised or lowered in said cylindrical housing in response to the direction of rotation of said shaft; and electrical switching means connected to said cable having positive, negative and neutral current flow positions when said cable is connected to a source of power, for controlling the operation of said motor in driving relation to said reduction gear linkage and said drive shaft to raise or lower or stop the motion of said load supporting shaft in said jack housing in accordance with the position of said switch;

wherein said supporting plate comprises means for securely accommodating the supporting base of said jack in secured detachable relation on said supporting plate; and wherein said means for securely accommodating the supporting base of said jack comprises a pair of inwardly-directed U-shaped flanges disposed along opposite edges of said supporting plate for accommodating the supporting base of said jack in slidable relation to said supporting plate.

5. A kit in accordance with claim 2 which includes said jack as an element of said kit, said jack being permanently secured to the surface of said supporting base.

6. A kit in accordance with claim 2 wherein said source of power available in said vehicle is the battery of said vehicle.

7. A kit in accordance with claim 6 wherein said terminal means is constructed to plug into the power outlet for the cigarette lighter on the dashboard of said vehicle.

8. A kit in accordance with claim 3 wherein the weight of said motor, said reduction gear linkage, and said jack mounted in fixed relation on said support platform do not exceed about 20 pounds in weight.

9. A kit in accordance with claim 1 wherein the voltage of said source of power does not exceed about 24 volts.

10. A kit in accordance with claim 2 comprising an electric light in a housing hingedly secured to said supporting plate, whereby said electric light in said housing is disposed to be rotated to a position for directing a beam upward.

11. A kit in accordance with claim 2 comprising clamping means secured to said supporting plate; and a battery operated signal light detachably secured in said clamping means.

12. A kit in accordance with claim 2 comprising an elongated handle; and means for detachably securing said handle to one end of said supporting plate.

13. A kit in accordance with claim 1 wherein said mechanical coupling means comprises a steel key having a head portion having a broad base portion which narrows to a restricted central portion from which an elongated member projects outwardly in symmetrical axial relation to said central portion terminating in a key which is constructed to mate in secured relation through a socket in the base of said jack in driving relation to the gearing means of said jack.

* * * * *